US007478441B2

(12) United States Patent
Johnson

(10) Patent No.: US 7,478,441 B2
(45) Date of Patent: Jan. 20, 2009

(54) WAVE SLIDE RIDE

(76) Inventor: Garrett T. Johnson, 2700 International Pkwy., Suite 700, Virginia Beach, VA (US) 23452

( * ) Notice: Subject to any disclaimer, the term of this patent is extended or adjusted under 35 U.S.C. 154(b) by 0 days.

(21) Appl. No.: 12/062,443

(22) Filed: Apr. 3, 2008

(65) Prior Publication Data

US 2008/0184473 A1 Aug. 7, 2008

Related U.S. Application Data

(63) Continuation-in-part of application No. 11/786,652, filed on Apr. 12, 2007, which is a continuation-in-part of application No. 11/290,906, filed on Nov. 30, 2005.

(60) Provisional application No. 60/921,537, filed on Apr. 3, 2007.

(51) Int. Cl.
*A47K 3/10* (2006.01)

(52) U.S. Cl. ..... 4/491; 4/507

(58) Field of Classification Search ..... 4/488, 4/491, 507, 510, 512, 541.1, 541.5; 405/79; 472/128, 129; 239/22, 23
See application file for complete search history.

(56) References Cited

U.S. PATENT DOCUMENTS 4,174,808 A * 11/1979 Latin ..... 239/23
4,276,664 A * 7/1981 Baker ..... 4/491
5,833,393 A * 11/1998 Carnahan et al. ..... 405/79
6,912,738 B2 * 7/2005 Black ..... 4/491

* cited by examiner

*Primary Examiner*—Tuan N Nguyen
(74) *Attorney, Agent, or Firm*—Williams Mullen; M. Bruce Harper

(57) ABSTRACT

A water ride for swimmers is provided, the ride having a pool with a body of water, an elongated tubular chamber, a compressed air system, and a water make up system. The chamber is substantially closed at one end, which is positioned generally underneath the bottom of the pool. The chamber is substantially open at the other end, which extends to provide a substantially vertical portion having an exposed length within the pool. Application of compressed air to the chamber produces an upsurge within the pool that cascades down to produce radiating swells. The upsurge and radiating swells provide a ride having a sliding effect for swimmers.

15 Claims, 9 Drawing Sheets

WAVE SLIDE RIDE

RELATED PATENT APPLICATIONS

This application claims benefit of the priority date of the U.S. Provisional Patent Application Ser. No. 60/921,537, filed on Apr. 3, 2007, titled "Wave Slide Ride," inventor Garrett Johnson, which is hereby incorporated by reference. This application is also a continuation in part of U.S. application Ser. No. 11/786,652, filed on Apr. 12, 2007, and U.S. application Ser. No. 11/290,906 filed on Nov. 30, 2005, both of which are hereby incorporated by reference.

STATEMENT REGARDING FEDERALLY SPONSORED RESEARCH OR DEVELOPMENT

Not applicable.

FIELD OF THE INVENTION

The present invention relates to a pool and a wave generating system. More particularly, the present invention is a pool ride having a slide feature.

BACKGROUND

Conventional water slides involve a form of tube, half round, or other slide structure having a jet or film of water flowing across the surface to reduce friction for riders. Generally, gravity is used as the primary motive force to propel the riders along the slide. The riders may also use mats or riding tubes to reduce further the friction between the rider and the surface of the slide. The reduced friction enables sliding riders to move easily and rapidly along the slide. In some cases, the water slide may include small water jets to assist in propelling the riders along the slide. At the end of the water slide, the riders are discharged into some form of pool.

Water slides typically provide structure to retain or conserve the flowing water within the slide and to re-direct riders as they travel along the slide. Gravity imparts an initial potential energy to the rider that is converted to kinetic energy, which as noted above, may be enhanced by water jets. Thus, the beginning of the slide must be positioned at some considerable elevation for the rider to begin sliding with available potential energy. During the slide, riders are separated or isolated by guiding structure for protection and for redirection.

It would be desirable to have a water ride that uses a form of energy different from the potential energy in elevation. Further, it would be useful to have a water ride that produces a sliding effect, but in which the riders are not isolated from each other until the discharge pool.

SUMMARY OF THE INVENTION

The present invention is a pool that is configured to produce a water upsurge, which cascades down to create swells that provide a ride having a sliding effect for swimmers.

An aspect of this water ride for swimmers is a pool having a bottom and at least one side wall so that the at least one side wall and bottom form a container capable of containing a body of water, so that the water may have a range of desired surface levels. The pool bottom defines or includes at least one hole. The pool may be a variety of shapes, whether circular, rectangular, irregular, etc. The side wall may form an incline, such as a low slope to simulate a beach.

An elongated tubular chamber having a substantially closed rear end and a substantially open front end, the chamber may be viewed as having three portions. The first portion has the substantially closed rear end and may be positioned generally underneath the bottom of the pool. The second portion has the substantially open front end and is positioned in a substantially vertical orientation with respect to the bottom of the pool and passes through the at least one hole in the bottom for a predetermined exposed length into the pool, so that the open front end of the tubular chamber is in fluid communication with the water in the pool. The predetermined exposed length is generally below the desired surface level of the body of water. A protective cover may be disposed about the at least one hole and the predetermined exposed length to keep swimmers from getting too close. The third portion connects the first and second portions in fluid communication. The chamber may be anchored underneath the pool in a desired orientation, possibly by concrete, for example.

To prevent flow from the pool into the chamber, a discharge back flow prevention device is disposed in the second portion of the elongated tubular chamber, proximate to the open front end of the chamber. This preventer enable discharge of the chamber to the body of water, but stops back flow.

A compressed air system is included having a supply of compressed air fluidly interconnected with the rear end of the chamber and an air control valve in fluid communication with the supply of compressed air for operatively controlling the flow of compressed air into the chamber.

A supply of make-up water is also provided that is in fluid communication with the chamber; a make-up valve is interposed between and in fluid communication with the supply of make-up water and the chamber. In the event that the chamber were to reach a predetermined low pressure after any release of air into the rear end of the chamber, then makeup valve opens and the supply of make-up water introduces water into the rear end of the chamber to relieve the low pressure.

The actuation of the air control valve releases the compressed air into the rear end of the chamber to forcibly expel a portion of the water within the chamber out of the open front end forming an upsurge of water in and above the surface of the body of water. The cascade return of the water causes at least one swell in the body of water radiating away from the elongated chamber.

Optionally, the second portion of the chamber may define an inner surface circumscribing a flow area cross section for the water that generally decreases in a direction moving toward the open front end. Alternatively, this feature may be provided by at least one vane attached to the inner surface.

DETAILED DESCRIPTION

The present invention is a pool in which is configured to produce a water upsurge that provides a ride having a sliding effect for swimmers. This approach uses the energy from the expansion of compressed air in a chamber to generate this effect.

A form of device adapted for the present invention may be seen in U.S. Pat. No. 5,833,393 to Carnahan et al. (or the '393 patent), which is hereby incorporated by reference. That device relied on submerged, elongated chambers (e.g., tubes) that were effectively or substantially open at one end and substantially closed at the other end. The device operated by releasing bursts of pressurized air that forced water out of the chamber and into a body of water to form a wave. The air then escaped out the open end of the chamber and into the body of water, following the expelled water. Water then refilled the chamber. As noted in U.S. application Ser. No. 11/786,652, the '393 patent design presented certain efficiency and structural challenges. Further, the '393 patent does not disclose a configuration capable of producing a sliding effect for swimmers.

Figure 1A:
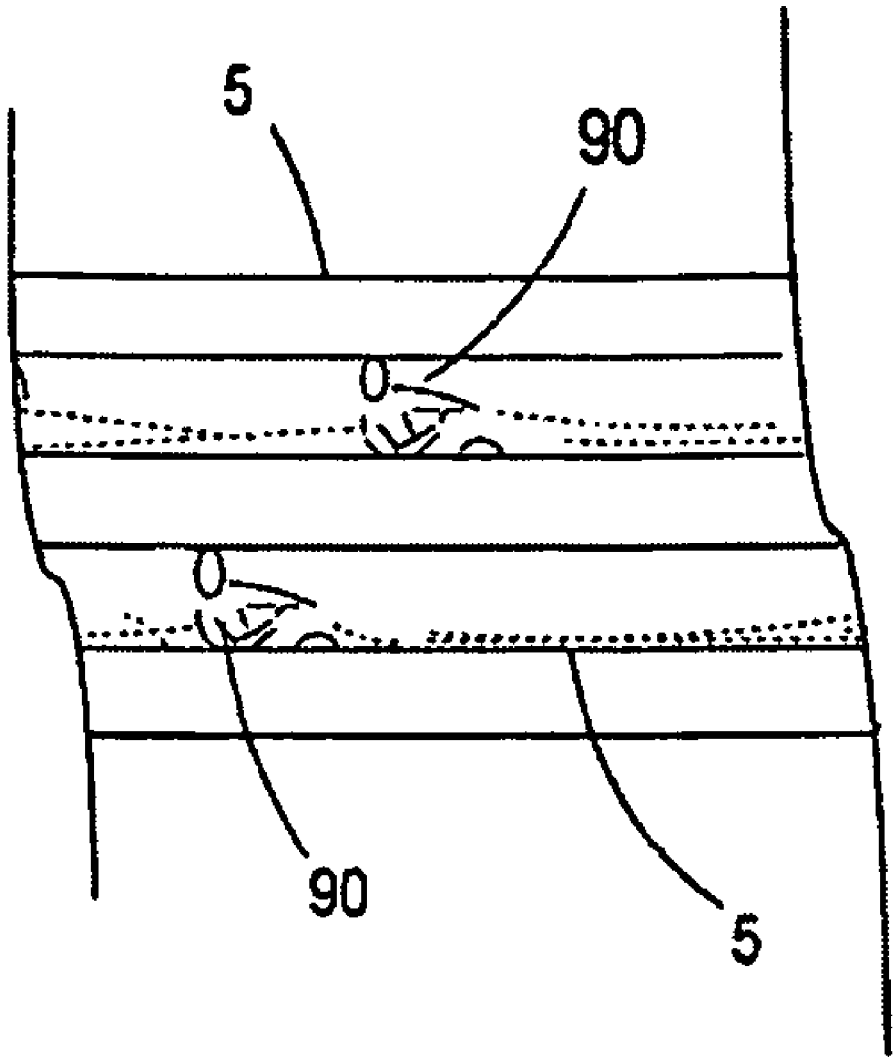
FIG. 1A (PRIOR ART)
FIGS. 1A and 1B are illustrations of prior art water rides, the first being a portion of a water slide and the second being a wave pool.
Figure 1B:
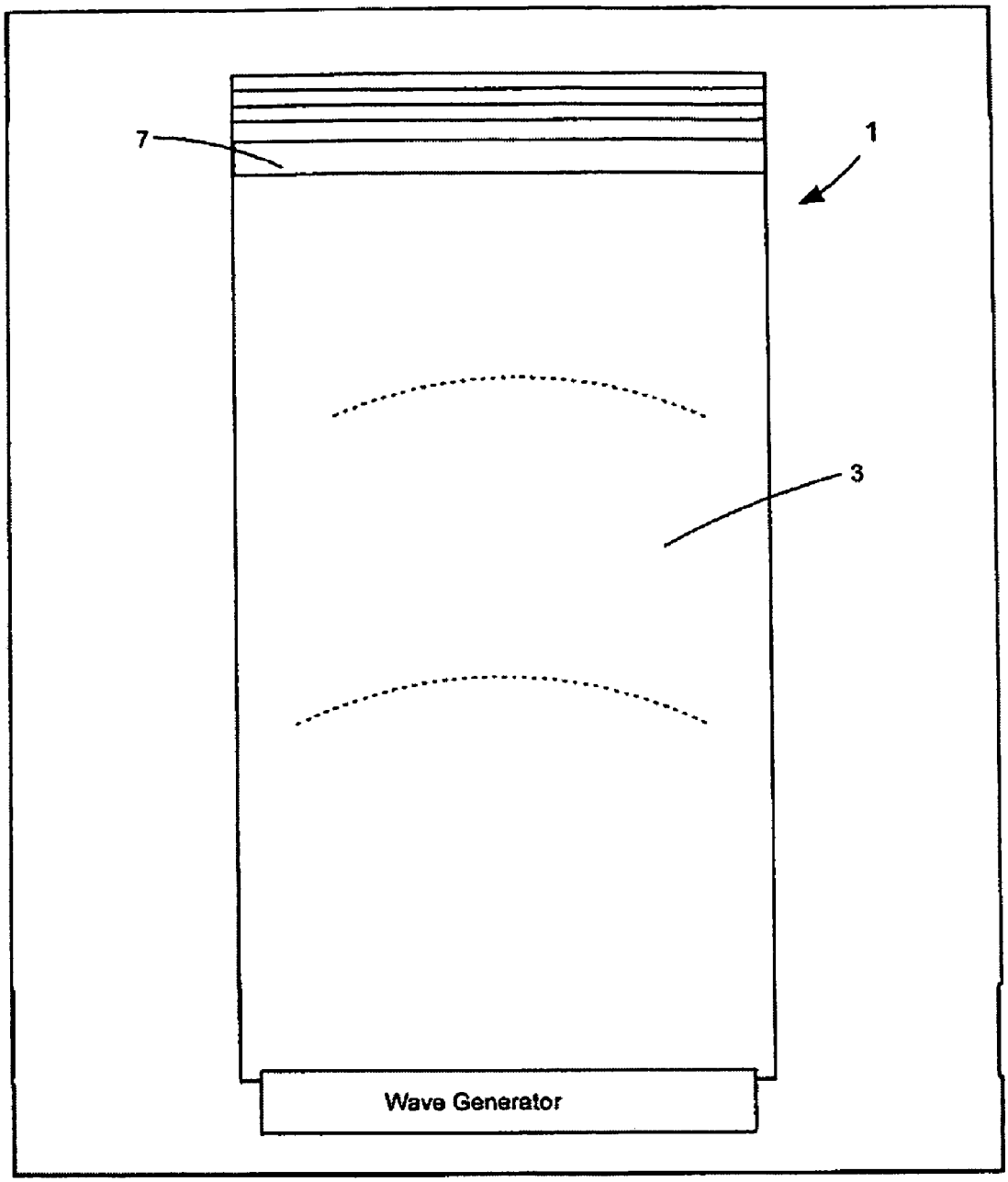
FIG. 1B (PRIOR ART)

FIG. 1A is a view of a portion of a conventional water slide in which swimmers 90 travel along chutes 5. As noted above, the primary source of energy for swimmers 90 is gravity, with a few water slides having water jets to aid in propulsion. As may be seen, swimmers 90 are separate within their own chutes 5. FIG. 1B is a diagram of a pool 1 in conventional form. Such pools are typically directed to maximizing the use of a roughly lateral wave. Accordingly, the pool shown is a traditional, rectangular design. Waves travel within course 3 along the length of pool 1 to break at shallows 7. Others have modified pool designs in order to achieve certain effects with or characteristics of the wave, as shown for example in U.S. Pat. No. 6,912,738 to Black, which is incorporated by reference.

Figure 2:
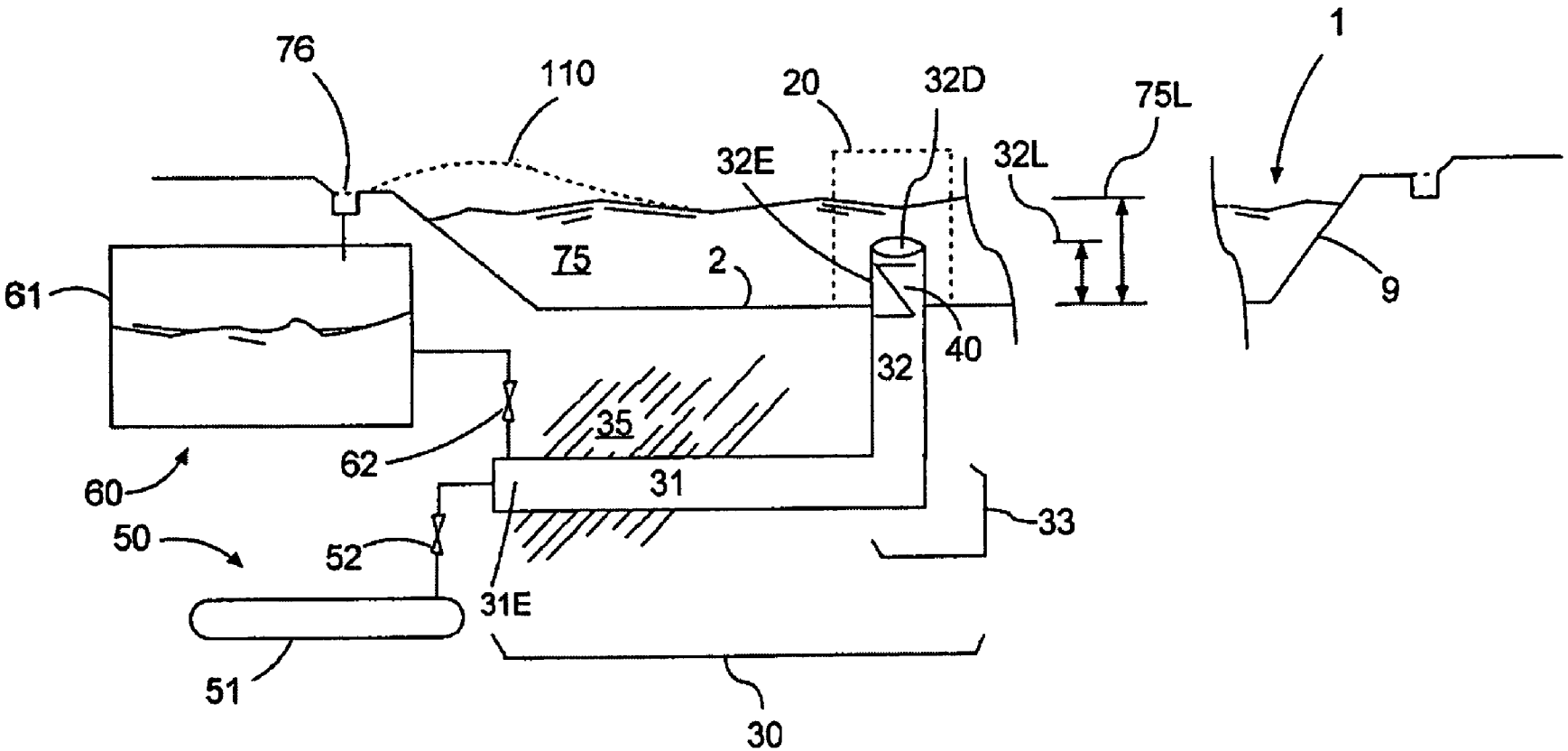
FIG. 2 is a side view schematic of an embodiment of the present invention.

With reference to the side schematic view of FIG. 2, an aspect of the invention is thus a water ride for swimmers 90 (not shown) in pool 1 having a generally horizontal bottom 2 and at least one side wall 9 so that the at least one side wall 9 and bottom 2 form a container capable of containing body of water 75. The body of water 75 may have a range of desired surface levels 75L suitable for the design of pool 1. In general, bottom 2 of pool 1 should define at least one hole 2H (not shown here, see in FIGS. 4-5.) Side wall 9 may be oriented substantially vertically relative to the bottom, including comprising an incline of less than ninety degrees relative to horizontal so as to simulate a beach and enable easy access to pool 1.

An elongated tubular chamber 30 having a substantially closed rear end 31E and a substantially open front end 32D may be used to create upsurge 100 (not shown). The chamber 30 may be considered as having three portions 31, 32, 33. The first portion 31, with the substantially closed rear end 31E, is positioned generally underneath the bottom 2 of the pool 1. Preferably, first portion 31 is set in an anchoring medium such as concrete 35 to anchor elongated chamber 30 in a desired orientation. The second portion 32, with the substantially open front end 32D, is positioned in a substantially vertical orientation with respect to the bottom 2 of pool 1. The second portion 32 passes through the at least one hole 2H (not shown) for a predetermined exposed length 32L into the pool 1 so that the open front end 32D of the tubular chamber 30 is in fluid communication with the body of water 75. In general, the predetermined exposed length 32L is below the desired surface 75L of the body of water 75. The third portion 33 connects first portion 31 and second portion 32 in fluid communication.

Figure 3A:
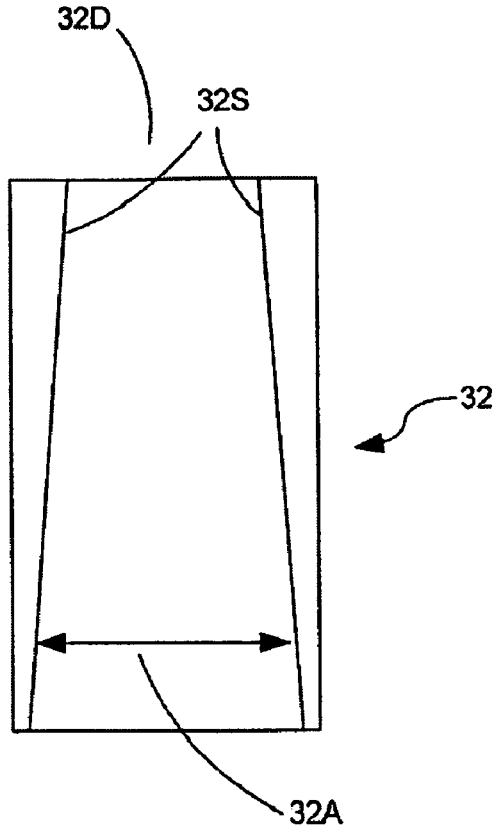
FIGS. 3A and 3B are cross section views of embodiments of the second portion of the elongated tubular chamber.
Figure 3B:
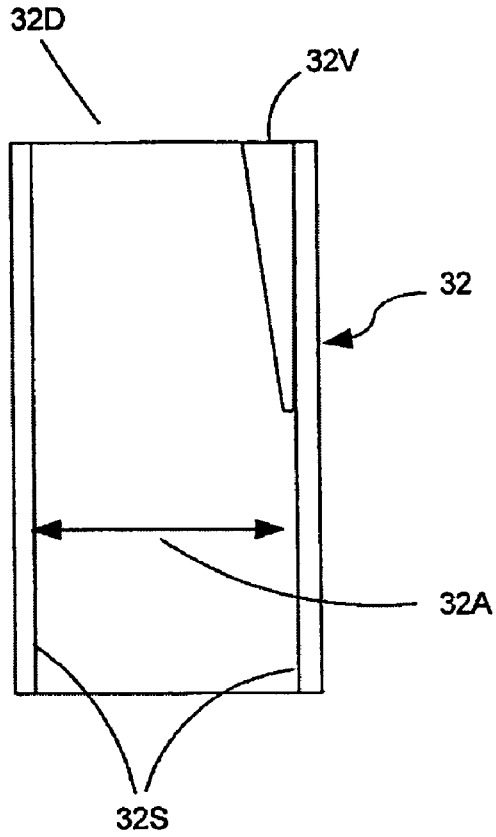

As may be seen in FIGS. 3A and 3B, the second portion 32 of chamber 30, being generally tubular, defines an inner surface 32S circumscribing a flow area cross section 32A. This flow area cross section 32A may decrease moving toward the open front end 32D in order to concentrate the flow into upsurge 100 (not shown). Alternatively, the flow area cross section 32A may be decreased by optional vane 32V attached to the inner surface 32S of the second portion of the chamber 30.

Returning to FIG. 2, optionally, a protective cover 20 or grill may be disposed about the at least one hole 2H and the predetermined exposed length 2E of the second portion 32 of the elongated chamber 30. This cover 20 may be a grill, screen, or otherwise define a plurality of openings permitting free passage of water 75 but blocks access of swimmers 90 to the elongated chamber 30 and the cascading return of upsurge 100.

Preferably, discharge back flow prevention device 40 is disposed in the second portion 32 of the elongated tubular chamber 30 proximate to the open front end 32D. The back flow prevention device 40 permits discharge of the chamber 30 into the body of water 75 but inhibits reverse flow from the body of water 75 into the chamber 30 along the open front end 32D. Optionally, the backflow prevention device 40 may be a check valve. Optionally, backflow prevention device may be a check valve 40 defining an equalization orifice that permits a small flow of water through the valve when in the shut position to permit equalization of pressure across the check valve at a desired rate.

Several systems support the operation of the elongated chamber 30. A compressed air system 50 having supply of compressed air 51 is fluidly interconnected with the rear end 31E of the chamber 30 via an air control valve 52 that operatively controls the flow of compressed air into the chamber 30.

Actuation of air control valve 52 releases compressed air into the rear end 31E of the chamber 30 to forcibly expel a portion of the water within the chamber 30 out of the open front end 32D. This release may form a desirable upsurge 100 of water in and above the surface 75L of the body of water 75, as shown in FIG. 4.

Upsurge 100 is to be distinguished from a complete expulsion of water from chamber 30 or from a discharge in which expelled water does not move above the general level of the surface 75L of the body of water 75. The inventors have discovered the formation of a preferable upsurge 100 using about a 1-2 second discharge of 15-80 psi compressed into a model chamber 30 formed of 6 inch diameter pipe having an approximate length of 14 feet. In this example, upsurge 100 was formed from a portion of water within the chamber 30 traveling above the surface of body of water 75L. The return of upsurge 100 formed a cascade into body of water 75 forming current and swells 110 rapidly radiating away from chamber 30. The cascade, current, and swells 110 would enable a swimmer 90 to travel rapidly outward and away from chamber 30.

Figure 4:
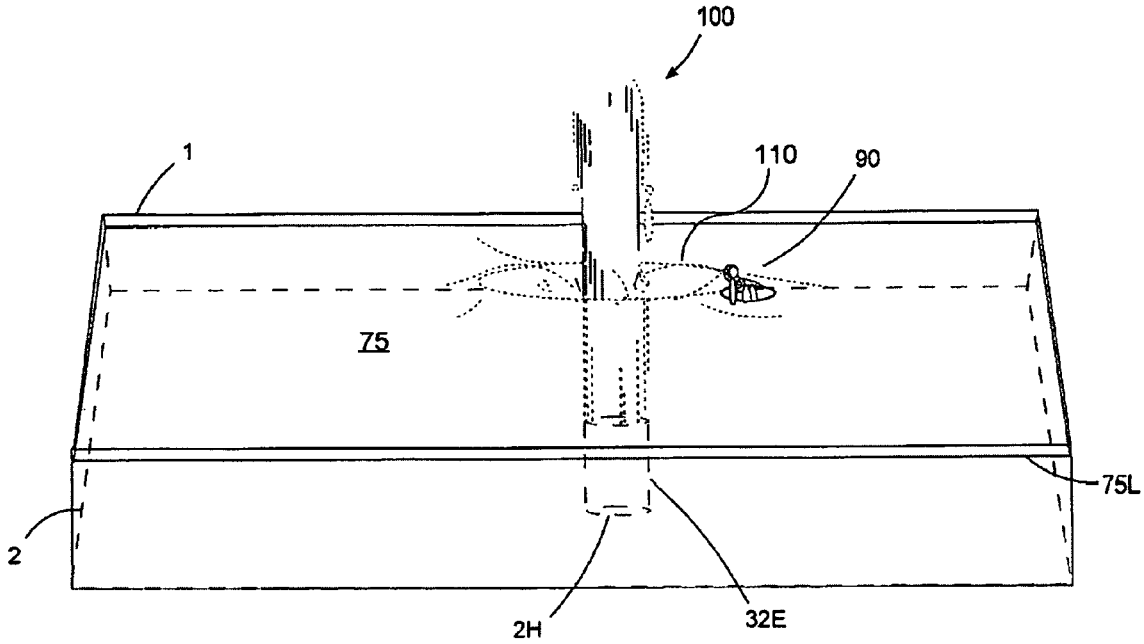
FIG. 4 is a perspective view of an embodiment of the present invention with an upsurge.

FIG. 4 is a perspective view of an aspect of the present invention. The present invention thus involves configuring an elongated chamber 30 relative to pool 1 to produce a vertical flow or upsurge 100 within water 75. Elongated chamber 30 (exposed 32E) is preferably oriented to discharge substantially vertically into the center of wave 1 from below the pool floor 2. Such a vertical discharge will initially create a pronounced upsurge 100 within water 75 of pool 1 as water is displaced or expelled by the chamber 30. As depicted, swimmer 90 may be positioned with respect to upsurge 100 so as to be initially elevated partly by upsurge 100 and then carried along by radiating swells 110. The sides of vertically oriented upsurge 100 will initially be steep, causing rider 50 to rise and then to slide or travel down upsurge 100.

Figure 5:
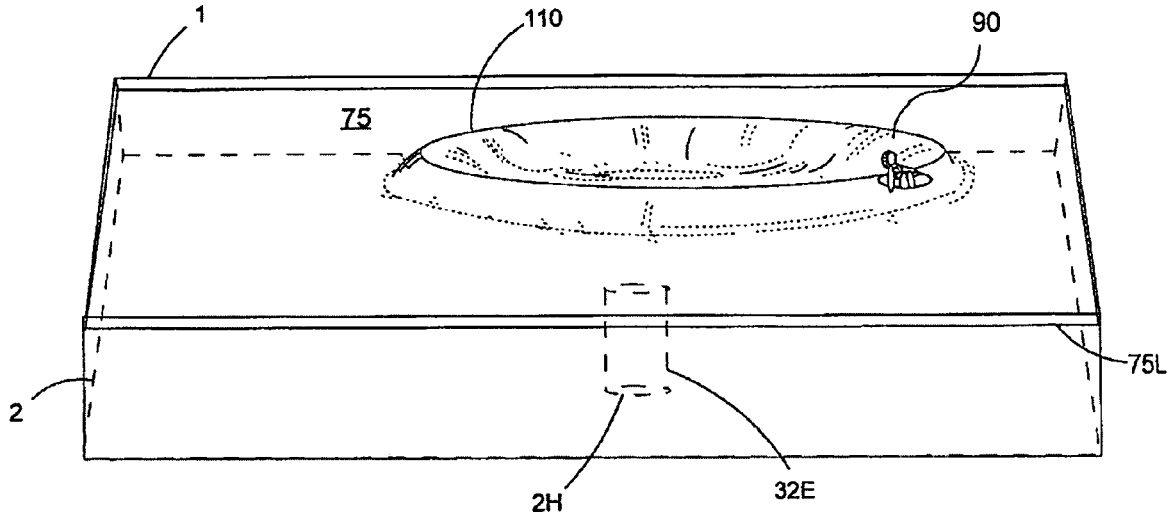
FIG. 5 is a perspective view of an embodiment of the present invention after an upsurge with a radiating swell.

As shown in FIG. 5, upsurge 100 will transition into expanding radial swells 110 in water 75 as the wave energy travels within wave 1. The dissipation of energy within water 75 in the form of swell 110 also carries rider 50 along. Thus, rider 50 may be positioned initially for a vertical fall along upsurge 100 that then is translated to horizontal travel along swell 110.

Figure 7:
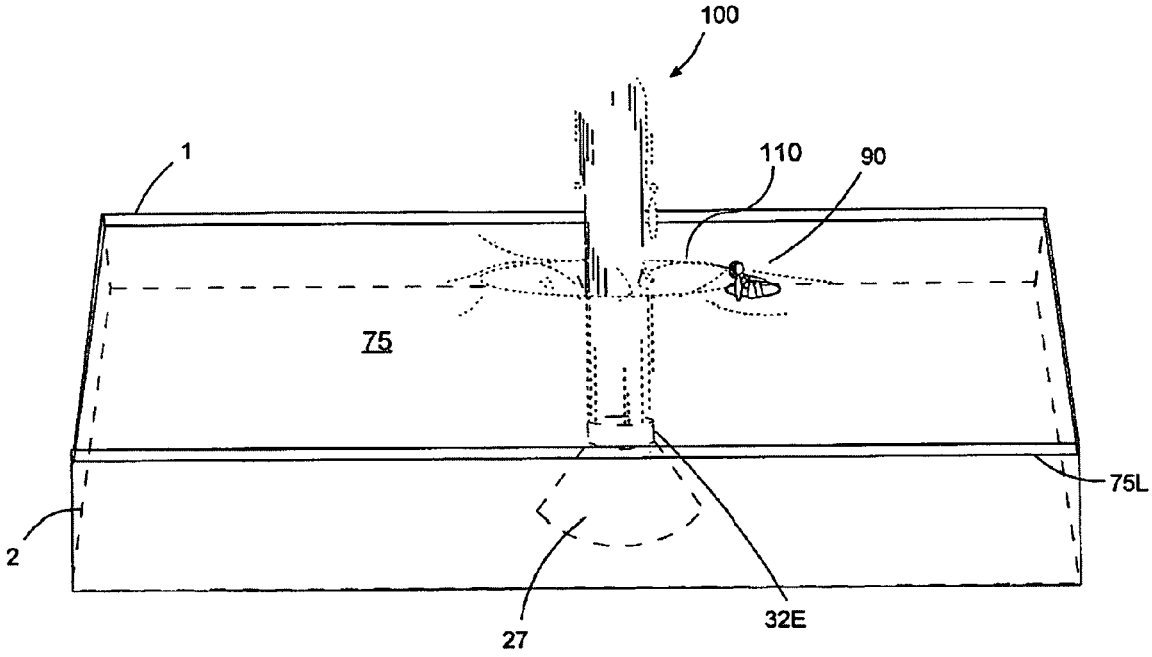
FIG. 7 is a perspective view of an aspect of an embodiment of the present invention.

An optional aspect of the invention is shown in FIG. 7, a collar 27 within the pool 1 disposed about the exposed second portion 32E of the elongated chamber 30. This collar 27 may define a slope that diminishes in height in a direction away from the elongated chamber 30. The collar 27 may then further enhance the radiation of the cascade into swells 110.

With reference to FIG. 2, another aspect of the invention is a controllable embodiment in which elongated chamber 30 defines an average diameter of flow area 32A and the difference between the predetermined exposed length 32L of the second portion 32 of the elongated chamber 30 and the desired surface level 75 is about half the average diameter.

Another aspect of the invention is a make up system 60 having supply of make-up water 61 is provided in fluid communication with the chamber 30 via a make-up valve 62 interposed between and in fluid communication with the supply of make-up water 61 and the chamber 30. Thus, in the event the chamber 30 reaches a predetermined low pressure after the release of air into the rear end 31E of the chamber 30, the make-up valve 62 opens and the supply of make-up water 61 introduces water into the rear end 31E of the chamber to relieve the low pressure. Optionally, a spill water collection system 76 may be disposed about at least a portion of the periphery of the pool 1 and in fluid communication with the supply of make-up water 61. This spill collection system 76 may be configured to collect at least a portion of spill water from swells 110 created by upsurge 100 and to deliver the spill water to the supply of make-up water 61. A spill water collection system 76 solves two problems: capture of water from swells 110 to obviate interference from return waves, and re-supply of make up water.

Figure 6:
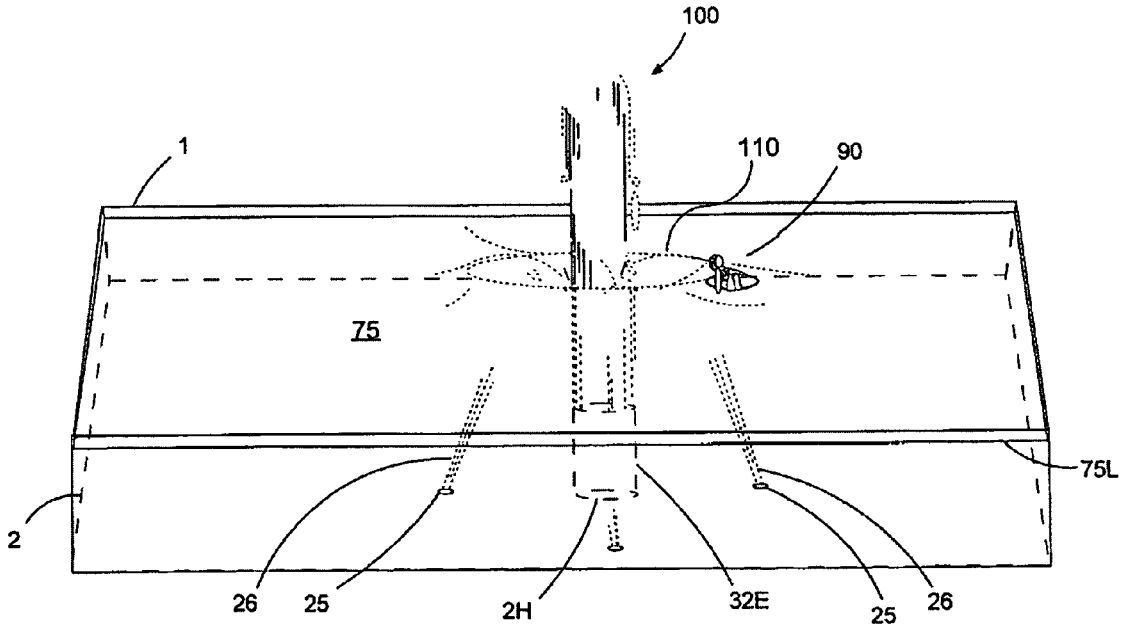
FIG. 6 is a perspective view of an aspect of an embodiment of the present invention.

With reference to FIG. 6, optionally pool 1 may include a plurality of water jets 25 spaced apart and positioned about the at least one hole 2H at predetermined locations. Preferably, water jets 25 may be oriented so as to emit a plurality of streams 26 of water within the pool that are adapted to contact a swimmer 90 in the vicinity of the at least one hole 2H. This feature may make it easier for swimmer 90 to remain in the vicinity of the elongated chamber 30 if swimmer 90 is on a float. Optionally, the plurality of water jets 25 may be configured so as to interrupt operation upon the admission of compressed air into the elongated chamber 30.

Figure 8:
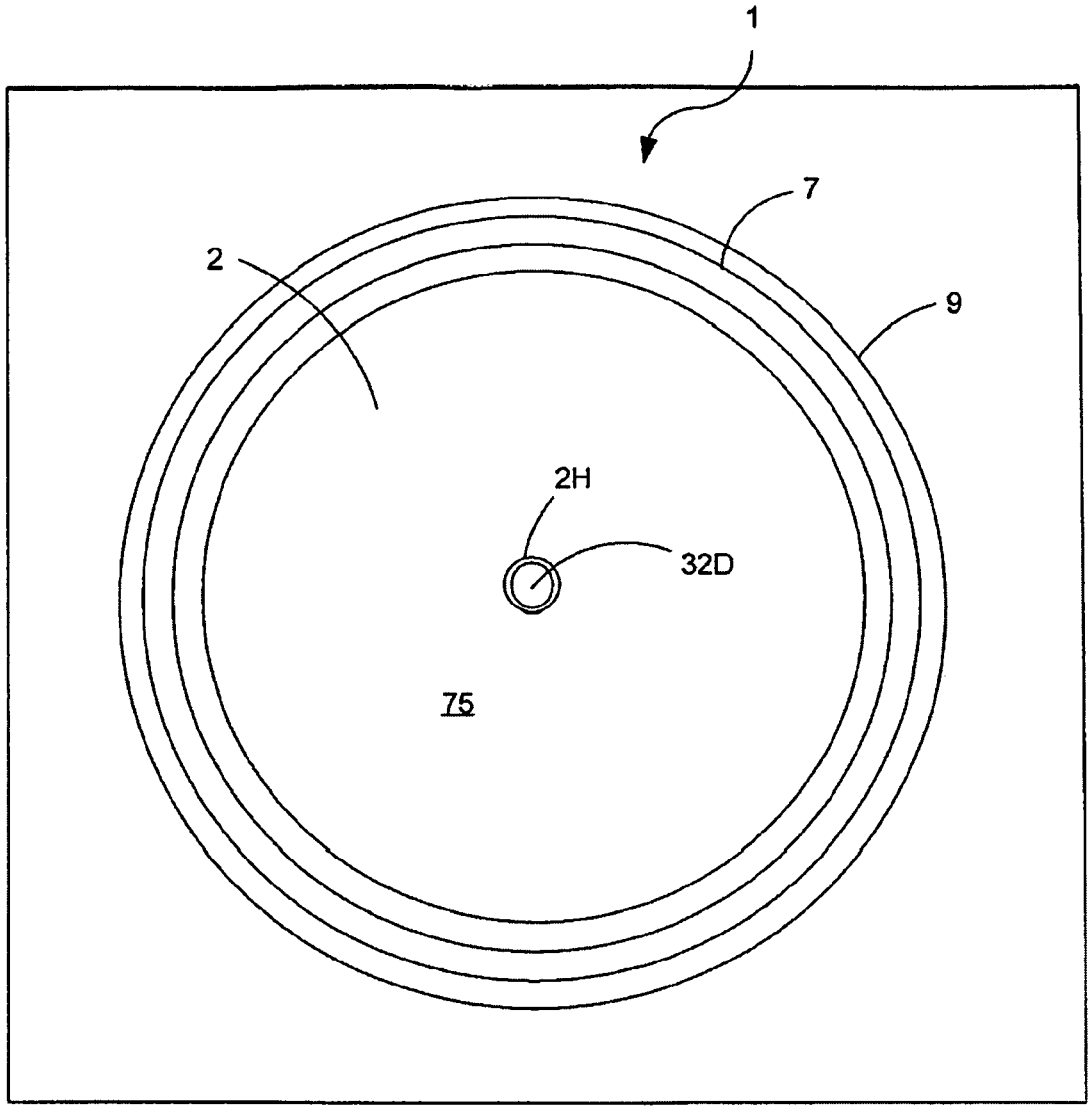
FIG. 8 is a top view of an embodiment of the present invention.

As may be seen in the FIGS. 2-8, pool 1 may take a wide variety of configurations or shapes. Pool 1 may be substantially rectangular (i.e., including square), polygonal, circular, irregular, etc. For example, as shown in FIG. 8, pool 1 may be substantially circular and the at least one hole 2H in the bottom 2 may be positioned proximate to the center of the pool 1. Note optional increasing elevation or steps 7 near the edges or side walls 9. In some cases, a circular or oval configuration of wave 1 may be preferable, though not required, to enable full exploitation of the expanding swells 110 (not shown). Alternatively, pool 1 may be substantially rectangular defining a length and a width. Optionally, with such a rectangular pool 1, the elongated chamber 30 may be substantially rectangular in proportion to the pool 1, so that the open front end 32D of the elongated chamber 30 may be substantially aligned along the width of the pool 1 so as to enable a linear upsurge along the width of the pool 1.

The above examples should be considered to be exemplary embodiments, and are in no way limiting of the present invention. Thus, while the description above refers to particular embodiments, it will be understood that many modifications may be made without departing from the spirit thereof.

What is claimed is:

1. A water ride for swimmers, comprising:

a pool having a generally horizontal bottom and at least one side wall so that the at least one side wall and bottom form a container capable of containing a body of water having a range of desired surface levels, wherein the bottom defines at least one hole;

an elongated tubular chamber having a substantially closed rear end and a substantially open front end, the chamber comprising a first, second, and third portions, wherein the first portion has the substantially closed rear end and is positioned generally underneath the bottom of the pool, the second portion has the substantially open front end and is positioned in a substantially vertical orientation with respect to the bottom of the pool and passes through the at least one hole in the bottom for a predetermined exposed length into the pool so that the open front end of the tubular chamber is in fluid communication with the body of water, wherein the predetermined exposed length is below the desired surface level of the body of water, and the third portion connects the first and second portions in fluid communication;

a discharge back flow prevention device disposed in the second portion of the elongated tubular chamber proximate to the open front end of the chamber and enabling discharge of the chamber to the body of water but inhibiting reverse flow from the body of water into the chamber along the open front end;

an anchor securing the chamber for maintaining the chamber in a desired orientation;

a supply of compressed air fluidly interconnected with the rear end of the chamber;

an air control valve in fluid communication with the supply of compressed air for operatively controlling the flow of compressed air into the chamber, a supply of make-up water in fluid communication with the chamber;

a make-up valve interposed between and in fluid communication with the supply of make-up water and the chamber;

wherein actuation of the air control valve releases the compressed air into the rear end of the chamber to forcibly expel a portion of the water within the chamber out of the open front end forming an upsurge of water in and above the surface of the body of water causing at least one swell in the body of water radiating away from the elongated chamber; and wherein in the event the chamber reaches a predetermined low pressure after the release of air into the rear end of the chamber, the makeup valve opens and the supply of make-up water introduces water into the rear end of the chamber to relieve the low pressure.

2. The water ride of claim 1, further comprising a protective cover disposed about the at least one hole and the predetermined exposed length of the second portion of the elongated chamber, the cover defining a plurality of openings permitting free passage of water but blocking swimmer access to the elongated chamber.

3. The water ride according to claim 1, wherein the second portion of the chamber defines an inner surface circumscribing a flow area cross section that generally decreases in a direction moving toward the open front end.

4. The water ride according to claim 1, wherein the second portion of the chamber defines an inner surface circumscribing a flow area cross section, and the second portion further comprises at least one vane attached to the inner surface so as to generally decrease the flow area cross section in a direction moving toward the open front end.

5. The water ride according to claim 1, wherein the pool further comprises a plurality of water jets spaced apart and positioned about the at least one hole at predetermined locations, wherein the water jets are oriented so as to emit a plurality of streams of water within the pool that are adapted to contact a swimmer in the vicinity of the at least one hole and act to retain the swimmer in the vicinity of the elongated chamber.

6. The water ride according to claim 1, wherein the pool further comprises a plurality of water jets spaced apart and positioned about the at least one hole at predetermined locations, wherein the water jets are oriented so as to emit a plurality of streams of water within the pool that are adapted to contact a swimmer in the vicinity of the at least one hole and act to retain the swimmer in the vicinity of the elongated chamber, and further wherein the plurality of water jets are configured so as to interrupt operation upon the admission of compressed air into the elongated chamber.

7. The water ride according to claim 1, wherein the pool is substantially rectangular.

8. The water ride according to claim 1, wherein the pool is substantially rectangular defining a length and a width, and wherein the elongated chamber is substantially rectangular in proportion to the pool, so that the open front end of the elongated chamber may be substantially aligned along the width of the pool so as to enable a linear upsurge along the width of the pool.

9. The water ride according to claim 1, wherein the pool is substantially circular and the at least one hole in the bottom is positioned proximate to the center of the pool.

10. The water ride according to claim 1, wherein the side wall comprises an incline of less than ninety degrees relative to horizontal so as to simulate a beach.

11. The water ride according to claim 1, further comprising a spill water collection system disposed about at least a portion of the periphery of the pool and in fluid communication with the supply of make-up water, the spill collection system being configured to collect at least a portion of spill water from swells created by the upsurge and to deliver the spill water to the supply of make-up water.

12. The water ride according to claim 1, wherein the backflow prevention device is a check valve.

13. The water ride according to claim 1, where the backflow prevention device is a check valve defining an equalization orifice permitting a flow of water through the valve to permit equalization of pressure across the check valve at a desired rate.

14. The water ride according to claim 1, wherein the elongated chamber defines an average diameter and the difference between the predetermined exposed length of the second portion of the elongated chamber and the desired surface level is about half the average diameter.

15. The water ride according to claim 1, further comprising a collar within the pool and disposed about the exposed second portion of the elongated chamber, the collar defining a slope that diminishes in height in a direction away from the elongated chamber.

* * * * *